United States Patent [19]

Goffe

[11] 3,998,635

[45] Dec. 21, 1976

[54] IMAGING SYSTEM

[75] Inventor: William L. Goffe, Webster, N.Y.

[73] Assignee: Xerox Corporation, Stamford, Conn.

[22] Filed: Apr. 10, 1975

[21] Appl. No.: 567,049

Related U.S. Application Data

[60] Division of Ser. No. 837,780, June 30, 1969, Pat. No. 3,975,195, which is a continuation-in-part of Ser. Nos. 725,676, May 1, 1968, abandoned, Ser. No. 460,377, June 1, 1965, Pat. No. 3,520,681, and Ser. No. 483,675, Aug. 30, 1965, Pat. No. 3,656,990, said Ser. No. 725,676, is a continuation-in-part of Ser. No. 460,377, , Ser. No. 483,675, , and Ser. No. 403,002, Oct. 12, 1964, abandoned, said Ser. No. 460,377, and Ser. No. 483,675, each is a continuation-in-part of Ser. No. 403,002.

[52] U.S. Cl. ..... 96/1 PS; 96/1.1; 96/1 R

[51] Int. Cl.[2] ..... G03G 13/00

[58] Field of Search ..... 96/1 PS, 1.1, 1 R

[56] References Cited

UNITED STATES PATENTS

| | | | |
|---|---|---|---|
| 3,676,117 | 7/1972 | Kinoshita | 96/1 |
| 3,719,482 | 3/1973 | Goffe | 96/1.1 |

*Primary Examiner*—John D. Welsh

[57] ABSTRACT

Material from a layer of migration material spaced apart from at least one surface of, but contacting a softenable layer is caused to imagewise selectively migrate to at least locations in depth in the softenable layer, by (A) subjecting said migration material to an imagewise migration force and changing the resistance of said softenable layer, to migration of migration material or by (B) subjecting said migration material to a migration force and imagewise changing the resistance of said softenable layer to migration of migration material.

35 Claims, 11 Drawing Figures

IMAGING SYSTEM

CROSS-REFERENCES TO RELATED APPLICATIONS

This is a division of application Ser. No. 837,780 filed June 30, 1969 now U.S. Pat. No. 3,975,195, which is a continuation-in-part of my copending U.S. Patent Applications (1) Ser. No. 725,676, filed May 1, 1968 abandoned; (2) Ser. No. 460,377, filed June 1, 1965 now U.S. Pat. No. 3,520,681 and (3) Ser. No. 483,675, filed Aug. 30, 1965 now U.S. Pat. No. 3,656,990; Application (1) being a continuation-in-part of (2)and (3) and Application Ser. No. 403,002, filed Oct. 12, 1964, now abandoned; (2) and (3) both being continuations-in-part of Ser. No. 403,002.

BACKGROUND OF THE INVENTION

This invention relates in general to imaging, and more specifically to a new migration imaging system.

There has recently been developed a migration imaging system capable of producing high quality images of high density, continuous tone, and high resolution, an embodiment of which is described in my copending application Ser. No. 460,377, filed June 1, 1965. Generally, according to an embodiment thereof, an imaging member comprising a substrate with a layer of softenable material, containing photosensitive particles, overlying the substrate is imaged in the following manner: a latent image is formed on the member, for example, by uniformly electrostatically charging and exposing it to a pattern of activating electromagnetic radiation. The imaging member is then developed by exposing it to a solvent which dissolves only the softenable layer. The photosensitive particles which have been exposed to radiation migrate through the softenable layer as it is softened and dissolved, leaving an image of migrated particles corresponding to the radiation pattern of an original, on the substrate with the material of the softenable layer substantially completely washed away. The particle image may then be fixed to the substrate. For many preferred photosensitive particles, the image produced by the above process is a negative of a positive original, i.e., particles deposit in image configuration corresponding to the radiation exposed areas. However, positive to positive systems are also possible by varying imaging parameters. Those portions of the photosensitive material which do not migrate to the substrate are washed away by the solvent with the softenable layer. As disclosed therein, by other developing techniques, the softenable layer may at least partially remain behind on the supporting substrate.

In general, three basic imaging members may be used: a layered configuration which comprises a substrate coated with a layer of softenable material, and a fracturable and preferably particulate layer of photosensitive material at or embedded near the upper surface of the softenable layer; a binder structure in which the photosensitive particles are dispersed in the softenable layer which overcoats a substrate; and an overcoated structure in which a substrate is overcoated with a layer of softenable material followed by an overlayering of photosensitive particles and a second overcoating of softenable material which sandwiches the photosensitive particles. Fracturable layer or material as used herein, is intended to mean any layer or material which is capable of breaking up during development and permitting portions to migrate towards the substrate in image configuration.

The imaging system of 460,377 generally comprises a combination of process steps which include forming a latent image and developing with solvent liquid or vapor, or heat or combinations thereof to render the latent image visible. In certain methods of forming the latent image, non-photosensitive or inert, fracturable layers and particulate material may be used to form images, as described in copending application Ser. No. 483,675, filed Aug. 30, 1965, wherein a latent image is formed by a wide variety of methods including charging in image configuration through the use of a mask or stencil; first forming such a charge pattern on a separate photoconductive insulating layer according to conventional xerographic reproduction techniques and then transferring this charge pattern to the imaging member by bringing the two layers into very close proximity and utilizing breakdown techniques as described, for example, in Carlson U.S. Pat. No. 2,982,647 and Walkup U.S. Pat. Nos. 2,825,814 and 2,937,943. In addition, charge patterns conforming to selected, shaped, electrodes or combinations of electrodes may be formed by the "TEST" discharge technique as more fully described in Schwertz Patents 3,023,731 and 2,919,967 or by techniques described in Walkup Patents 3,001,848 and 3,001,849 as well as by electron beam recording techniques, for example, as described in Glenn Pat. No. 3,113,179.

In another variation of the imaging system of 460,377, an image is formed by the selective disruption of a particulate material overlying or in an electrostatically deformable, or wrinklable film or layer. This variation differs from the system described above in that the softenable layer is deformed in conjunction with a disruption of the overlayer of material as described more fully in copending application Ser. No. 695,074, filed Jan. 2, 1968 now U.S. Pat. No. 3,542,545.

The characteristics of the images produced are dependent on such process steps as charging, exposure and development, as well as the particular combination of process steps. High density, continuous tone and high resolution are some of the image characteristics possible. The image is generally characterized as a fixed or unfixed particulate image with or without a portion of the softenable layer and unmigrated portions of the layer left on the imaged member, which can be used in a number of applications such as microfilm, hard copy, optical masks, and strip out applications using adhesive materials.

As disclosed in 460,377 and 483,675 and as further elaborated on herein, the layer of softenable material of the imaging member in some developing techniques is (a) substantially completely washed away (washaway development) and by other developing techniques (b) (softening development) may at least partially remain behind on the supporting substrate. The invention hereof is intended to encompass both (a) and (b) and indeed any and all suitable developing and softening techniques.

460,377 and 483,675 are hereby expressly incorporated by reference herein principally because of their ample teachings of washaway development and also their teachings of softening development where the softenable layer completely or partially remains after development herein. Especially softening development is elaborated on herein.

It will be seen that the invention hereof encompasses optimum electrical-optical modes of migration imaging, wherein latent images are formed by modes similar to those described in 460,377, preferred modes employing electrical migration forces associated with electrostatic images, optionally with a radiation exposure step, wherein latent images are formed by modes similar to those described in 483,675, as well as other novel and advatageous imaging modes wherein optical exposures are not necessary for imaging and wherein migration forces other than electrical forces are used as a migration force.

SUMMARY OF THE INVENTION

It is, therefore, an object of this invention to provide a controlled migration imaging system wherein portions of a layer of migration material, spaced apart from at least one surface of, but contacting a softenable layer is caused to imagewise migrate in depth in the softenable layer.

It is a further object of this invention to provide imaged members comprising migration material, which includes particles imagewise migrated to various depths in a softenable layer.

It is a further object of this invention to provide imaged members usable per se and which may be converted to treated in various ways, for example, to improve their optical character, to enhance their usability as an image.

It is a further object of this invention to provide a migration imaging system which need not but may employ direct contact of a solvent liquid with the imaging member.

It is a further object of this invention to provide a migration imaging system which is positive to positive or positive to negative depending upon a wide variety of pivotal factors.

The foregoing objects and others are accomplished in accordance with this invention by providing an imaging member comprising a layer of migration material spaced apart from at least one surface of, but contacting a softenable layer wherein material from said layer of migration material is caused to imagewise migrate to at least locations in depth in the softenable layer by (A) subjecting said migration material to an imagewise migration force and changing the resistance of said softenable layer, to migration of migration material or by (B) subjecting said migration material to a migration force and imagewise changing the resistance of said softenable layer to migration of migration material.

BRIEF DESCRIPTION OF THE DRAWINGS

For a better understanding of the invention as well as other objects and further features thereof, reference is made to the following detailed disclosure of this invention taken in conjunction with the accompanying drawings wherein.

DESCRIPTION OF THE PREFERRED EMBODIMENTS

Figure 1A:
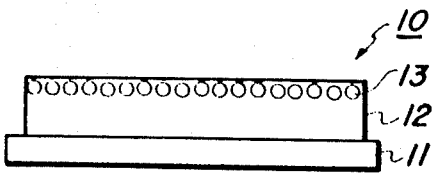
FIG. 1 is a partially schematic drawing representing a preferred method of forming a latent image on an embodiment of an imaging member, according to the optimum electrical-optical mode of migration imaging of this invention.

Referring now to FIG. 1A, there is shown a schematic drawing of an example of one embodiment of an imaging member 10 according to this invention comprising substrate 11, electrically insulating softenable layer 12 which contains at its upper surface a fracturable migration layer 13 of particulate material.

Substrate 11 may be electrically conductive or insulating. Conductive substrates generally facilitate the charging or sensitization of the member according to the optimum electrical-optical mode of the invention and typically may be of copper, brass, nickel, zinc, chromium, stainless steel, conductive plastics and rubbers, aluminum, steel, cadmium, silver, gold, or paper rendered conductive by the inclusion of a suitable chemical therein or through conditioning in a humid atmosphere to ensure the presence therein of sufficient water content to render the material conductive. The softenable layer may be coated directly onto the conductive substrate, or alternatively, the softenable layer may be self-supporting and may be brought into contact with a suitable substrate during imaging.

The substrate may be in any suitable form such as a metallic strip, sheet, plate, coil, cylinder, drum, endless belt, moebius strip or the like. If desired, the conductive substrate may be coated on an insulator such as paper, glass or plastic. Examples of this type of substrate are a substantially transparent tin oxide coated glass available under the trademark NESA from the Pittsburgh Plate Glass Co., aluminized polyester film the polyester film available under the trademark Mylar from DuPont, or Mylar coated with copper iodine.

Electrically insulating substrates may also be used which opens up a wide variety of film formable materials such as plastics for use as substrate 11.

Softenable layer 12, which may comprise one or more layers of softenable materials, may be suitable material, typically a plastic or thermoplastic material, which is soluble in a solvent or softenable for example, in a solvent liquid, solvent vapor, heat or combinations thereof, and in addition, for the optimum electricaloptical mode hereof is substantially electrically insulating during the migration force applying and softening steps hereof. It should be noted that layer 12 should preferably be substantially electrically insulating for the preferred modes hereof of applying electrical migration forces to the migration layer more conductive materials may be used because of the increased capability in the electrical mode hereof of applying a constant and replenishing supply of charges in image configuration. In these optimum and preferred modes, it is found that higher conductivity softenable layers 12 are accompanied by charge injection from the substrate into layer 12 and/or by other conductivity-related mechanisms which discharge layer 12 causing removal of the coulombic migrating force on the particle before migration has occurred satisfactorily. Where the softenable layer is to be dissolved either during or after imaging, it should be soluble in a solvent which does not attach the particles.

"Softenable" as used herein to depict layer 12 is intended to mean any material which can be rendered by the developing step hereof more permeable to particles migrating through its bulk. Conventionally changing permeability is accomplished by dissolving, melting and softening as by contact with heat, vapors, partial solvents and combinations thereof.

Typical substantially electrically insulating softenable materials include Staybelite Ester 10, a partially hydrogenated rosin ester, Foral Ester, a hydrogenated rosin triester, and Neolyne 23, an alkyd resin, all from Hercules Powder Co.; SR type silicone resins available from General Electric Corporation; Sucrose Benzoate, Eastman Chemical; Velsicol X-37, a polystyreneolefin coploymer from Velsicol Chemical Corp.; Hydrogenated piccopale 100, Piccopale H-2, highly branched polyolefins, Piccotex 100, a styrene-vinyl toluene copolymer, Piccoflastic A-75, 100 and 125, all polystyrenes, Piccodiene 2215, a polystyrene-olefin copolymer, all from Pennsylvania Industrial Chemical Corp.; Araldite 6060 and 6071, epoxy resins from Ciba; R5061A, a phenylmethyl silicone resin, from Dow Corning, Epon 1001, a bisphenol A-epichlohydrin epoxy resin, from Shell Chemical Corp.; and PS-2, PS-3, both polystyrenes, and ET-693, a phenol-formaldehyde resin, from Dow Chemical; custom synthesized copolymers of styrene and hexylmethacrylate, a custom synthesized polydiphenylsiloxane; a custom synthesized polyadipate; acrylic resins available under the trademark Acryloid from Rohm & Haas Co., and available under the trademark Lucite from the E. I. DuPont de Nemours & Co.; thermoplastic resins available under the trademark Pliolite from the Goodyear Tire & Rubber Co.; a chlorinated hydrocarbon available under the trademark Aroclor from Monsanto Chemical Co.; thermoplastic polyvinyl resins available under the trademark Vinylite from Union Carbide Co.; other thermoplastics disclosed in Gunther et al U.S. Patent No. 3,196,011; waxes and blends, mixtures and copolymers thereof.

The above group of materials is not intended to be limiting, but merely illustrative of materials suitable for softenable layer 12. The softenable layer may be of any suitable thickness, with thicker layers generally requiring a greater electrostatic potential in the optimum and preferred modes of this invention. Thicknesses from about ½ to about 16 microns have been found to be preferred, but a uniform thickness over the imaging area from about 1 to 4 microns is found to provide for high quality images while permitting ready image member construction.

Layer 12 may be formed by any suitable method including dip coating, roll coating, gravure coating, vacuum evaporation and other techniques.

Migration layer 13, portions of which migrate towards or to the substrate during image formation under influence of the migration forces hereof, illustratively is a fracturable layer of particles. While it is preferred for images of highest resolution density and utility that layer 13 be a fracturable layer and optimally that the fracturable material be particulate, layer 13 may comprise any continuous or semi-continuous, fracturable layer, such as a swiss cheese pattern, which is capable of breaking up into discrete particles of the size of an image element or less during the development step and permitting portions to migrate towards the substrate in image configuration.

In addition and importantly, layer 13 may be nonfracturable. It has been shown that a non-fracturable semicontinuous layer 13 may imagewise migrate in depth in the softenable material. It is preferred that the material be at least semicontinuous, such as a swiss cheese pattern, to allow it more readily to migrate into the softenable layer. For example, as shown in Example XI, thin non-fracturable swiss cheese films comprising selenium selectively imagewise migrated when processed according to the invention hereof to produce members may be viewed by reflected light, showing no detectable transmission density changes when compared to unimaged members. For at least small migration distances the film appears to stretch at the edges of the image areas. That the selenium layer of Example XI does not fracture as a result of imaging is shown by dipping the imaged member in a solvent liquid for the softenable material which prompts the selenium film to come off in a large sheet or sheets.

While layer 13 is preferably fracturable and optimally particulate, non-fracturable layers, preferably perforated may also be used to obtain images. Thus, it is seen that the mechanical characteristics of layer 13 may vary over a wide range. Because the mechanical characteristics of layer 13 may vary so widely, any one of a great number of methods of forming layer 13 may be used. Typical methods include deposition by vacuum evaporation techniques such as disclosed in copending application Serial No. 423,167, filed Jan. 4, 1965, wherein a migration fracturable layer of submicron size amorphous selenium, an especially preferred material in the electrical-optical mode hereof is formed on a softenable layer for example by evaporating and condensing in a vacuum at a deposition rate of about ½ micron per hour onto a substrate held at about 65° C. in a vacuum of about $10^{-4}$ to about $10^{-5}$ Torr. Vacuum evaporation may also be used to form nonfracturable layers of amorphous selenium and other materials. For example, a mechanically continuous non-fracturable migration layer comprising a predominating amount of selenium may be formed by holding the depositing substrate between about 30° C. and about 40° C., keeping the source temperature between about 230° C. and 260° C. in a partial vacuum of about $1.4 \times 10^{-6}$ Torr. and depositing enough selenium for a reasonable optical density in the resultant imaged members. The fracturable form of layer 13 may also be formed by other methods such as by cascading, dusting, etc. as shown in copending application 460,377, or be stripping and other methods as described in copending application Ser. No. 685,536, filed Nov. 24, 1967 or any other suitable method. If thicker coatings are desired, layer 12 may be softened slightly be heating, for example, to permit particles deposited on its surface to seat themselves, i.e. to sink a short distance into the plastic after which additional particles may be cascaded across or dusted over the plate.

The thickness of layer 13 is preferably from about 0.01 to about 2.0 microns thick, although five micron layers have been found to give good results for some materials.

When layer 13 comprises particles, a preferred average particle size is from about 0.01 to about 2.0 microns to yield images of optimum resolution and high density compared to migration layers having particles larger than about 2.0 microns. For optimum resultant image density the particles should not be much above about 0.7 microns in average particle size. Layers of particle migration material preferably should have a thickness ranging from about the thickness of the smallest element of migration material in the layer to about twice the thickness of the largest element in that layer. It should be recognized that the particles may not all be packed tightly together laterally or vertically so that some of the thickness of layer 13 may constitute softenable material.

Layer 13 may comprise any suitable material selected from an extremely broad group of materials and mixtures thereof including electrical insulators, electrical conductors, photosensitive materials and optically inert particles. For the modes hereof employing an electrical migration force the migrating portions of layer 13 should be sufficiently electrically insulating to hold their electrical migration force until the desired amount of migration has occurred. Conductive particles may be used, however, if lateral conductivity is minimized by loose packing, for example, or by partly embedding only a thin layer of particles in layer 12 so that neighboring particles are in poor electrical contact.

Migration material preferably should be substantially insoluble in the softenable material and otherwise not adversely reactive therewith, and in any solvent liquid or vapor which may be used in the softening step hereof.

Photosensitive materials for layer 13 permit the imaging members hereof to be latent imaged by the optimum electricaloptical mode hereof, to be further described, which is a simple, direct, optically sensitive method of producing high quality images according to this invention. Typical such photosensitive materials include inorganic or organic photoconductive insulating materials; materials which undergo conductivity changes when photoheated, for example, see Cassiers, Photog. Sci. Engr. 4. No. 4, 199 (1960); materials which photoinject, or inject when photoheated.

Photosensitive as used herein to describe materials for layer 13 more particularly means "electrically photosensitive". While photoconductive materials (and "photoconductive" is used in its broadest sense to mean materials which show increased electrical conductivity when illuminated with electromagnetic radiation and not necessarily those which have been found to be useful in xerography in a xerographic plate configuration) have been found to be a class of materials useful as "electrically photosensitive" overlayers in this invention and while the photoconductive effect is often sufficient in the present invention to provide an "electrically photosensitive" overlayer it does not appear to be a necessary effect. Apparently the necessary effect according to the invention is the selective relocation of charge into, within and out of layer 13, said relocation being effected by light action on the bulk or the surface of the "electrically photosensitive " material, by exposing said material to activating radiation; which may specifically include photoconductive effects, photoinjection, photoemmission, photochemical effects and other which cause said selective relocation of charge.

Any suitable electrically photosensitive material may be used herein. Typical such materials include organic or inorganic photoconductive insulating materials.

Preferred inorganic photoconductors for use herein becaused of the excellent quality of the resultant images include amorphous selenium; amorphous selenium alloyed with arsenic, tellurium, antimony or bismuth, etc.; amorphous selenium or its alloys doped with halogens; and mixtures of amorphous selenium and the crystalline forms of selenium including the monoclinic and hexagonal forms. Other typical inorganic photoconductors include cadmium sulfide, zinc oxide, cadmium sulfoselenide, cadmium yellows such as Lemon Cadmium Yellow X-2273 from Imperial Color and Chemical Dept. of Hercules Powder Co., and many others. Middleton et al U.S. Pat. No. 3,121,006 lists typical inorganic photoconductive pigments. Typical organic photoconductors include azo dyes such as Watchung Red B, a barium salt of 1-(4'-methyl-5'-chloro-azobenzene-2'- sulfonic acid)-2-hydrohydroxy-3-napthoic acid, C.I. No. 15865, a quinacridone, Monastral Red B, both available from DuPont; Indofast double scarlet toner, a Pyranthrone-type pigment available from Harmon Colors; Qunidomagenta RV-6803, a quinacridone-type pigment available from Harmon colors; Cyan Blue, GTNF, the beta form of copper phthalocyanine, C.I. No. 74160, available from Collway Colors; Monolite Fast Blue GS, the alpha form of metal-free phthalocyanine, C.I. No. 74100, available from Arnold Hoffman Co.; commercial indigo available from National Aniline Division of Allied Chemical Corp.; yellow pigments prepared as disclosed in copending applications Ser. No. 421,281, filed Dec. 28, 1964, or as disclosed in Ser. No. 445,235 filed Apr. 2, 1965, X-form metal-free phthalocyanine prepared as disclosed in copending application Ser. No. 505,723, filed Oct. 29, 1965, quinacridonequinone from DuPont, sensitized polyvinyl carbazole, Diane Blue, 3,3'-methoxy-4,4'-diphenyl-bis (1'' azo-2'' hydroxy-3'-naphthanilide), C. I. No. 21180, available from Harmon Colors; and Algol G. C., 1,2,5,6-di (D,D'-diphenyl)-thiazole-anthraquinone, C. I. No. 67300, available from General Dyestuffs and mixtures thereof. The above list of organic and inorganic photoconductive photosensitive materials is illustrative of typical materials, and should not be taken as a complete listing of photosensitive materials.

Any suitable photosensitive material or mixtures of such materials may be used in carrying out the invention, regardless of whether the particular material selected is organic, inorganic, is made up of one or more components in solid solution or dispersed one in the other, whether the layer is made up of different particles or made up of multiple layers of different materials.

Other materials which may be included in a photosensitive migration layer include organic donor-acceptor (Lewis acid-Lewis base) charge transfer complexes made up of donors such as phenolaldehyde resins, phenoxies, epoxies, polycarbonates, urethanes, styrene or the like complexed with electron acceptors such as 2,4,7-trinitro-9-fluorenone; 2,4,5,7-tetranitro-9-fluorenone; picric acid; 1,3,5-trinitro benzene; chloranil; 2,5-dichloro-benzoquinone; anthraquinone-2-carboxylic acid, 4-nitrophenol; maleic anhydride; metal halides of the metals and metalloids of groups I-B and II–VIII of the periodic table including for example aluminum chloride, zinc chloride, ferric chloride, magnesium chloride, calcium iodide, strontium bromide, chromic bromide, arsenic triiodide, magnesium bromide, stannous chloride etc.; boron halides, such as boron trifluorides; ketones such as benzophenone and anisil, mineral acids such as sulfuric acid; organic carboxylic acids such as acetic acid and maleic acid, succinic acid, citroconic acid, sulphonic acid, such as 4-toluene sulphonic acid and mixtures thereof.

As stated above, any suitable photosensitive material may be employed. In the optimum embodiment of a particulate, fracturable, migration layer, typical particles include those which are made up of only the pure photosensitive material or a sensitized form thereof, solid solutions or dispersions of the photosensitive material in a matrix such as thermoplastic or thermosetting resins, copolymers of photosensitive pigments and organic monomers, multi-layers of particles in which the photosensitive material is included in one of the layers and where other layers provide light filtering action in an outer layer of a fusible or solvent softenable core of resin or a core of liquid such as dye or other marking material or a core of one photosensitive material coated with an overlayer of another photosensitive material to achieve broadened spectral response. Other photosensitive structures include solutions, dispersions, or copolymers of one photosensitive material in another with or without other photosensitively inert materials. Other particle structures which may be used, if desired, include those described in U.S. Pat. No. 2,940,847 to Kaprelian. Also included are photosensitive materials wherein the change caused by radiation is permanent, persistent, or temporary. Also included are those particles which are thermoconductive, that is, the material is changed by the heating effects of the incident radiation.

While photosensitive materials may be used in the preferred electrical migration force mode, employing electrostatic images any suitable non-photosensitive migration material such as graphite, dyes, starch, garnet, iron oxide, carbon black, iron, tungsten and mixtures thereof may also be used as described in copending application Ser. No. 482,675, filed Aug. 30, 1965 and as further described herein.

It will also be appreciated that the migration layer 13 may comprise a mixture of materials specifically chosen for their color to give a color imaging system. For example, see copending application Ser. No. 609,056, filed Jan. 13, 1967.

In addition to the configuration shown in FIG. 1, with or without substrate 11, additional modifications in the basic structure such as an overcoated structure in which the migration material layer is sandwiched between two layers of softenable material may also be used. The overcoating layer may also be non-softenable such as gelatin or Mylar which may or may not contact the migration layer. Also, multiple layers each layer comprising a migration layer on or in a softenable layer may be used, with adjacent migration layers in the tiered structure separated from each other or touching.

Also the softenable layer may comprise one or more layers of different softenable materials with for example the migration layer contiguous the free surface of one layer of softenable material, which is coated on a supporting softenable layer optionally on a supporting substrate. As a further variation, one of the layers of softenable material may be stable against agglomeration of the migration material and another layer unstable against agglomeration to enhance the agglomerating, background reducing effect as described in copending application Ser. No. 612,122, filed Jan. 27, 1967, wherein the optical transmission of the unmigrated fracturable material is greatly increased by a truly astounding agglomeration effect of the unmigrated material to substantially transparentize these portions of the imaging member.

Thus, there has been described the layered configuration migration imaging member of this invention which is separately disclosed in greater detail, and claimed in copending application Ser. No. 635,256, filed May 1, 1967.

Referring now to the imaging methods of this invention and how material of the migration layer of the member described above is caused to migrate in depth in the softenable layer; broadly, the imaging methods of this invention can be divided into two modes:

A. applying to the migration layer material an imagewise migration force, which typically is associated with a latent imagewise change of the imaging member which changes directly or indirectly the force on the migration layer toward the bulk of the softenable layer and typically toward a face of the softenable layer or, where a substrate is used, toward the substrate-softenable layer interface; said migration material force applying step occurring before, during or after a second step of changing the resistance of said softenable material layer to migration of migration material; and B. applying to the migration layer material a migration force before, during or after a second step of imagewise changing the resistance of said softenable material to migration of migration material.

By either mode (A) or (B) above there are a variety of forces which can be applied to and be made to act on the migration layer to cause it to move in image configuration in depth in a softenable layer. Such forces include electrical or electrostatic, magnetic, gravitational, and centrifugal forces. An even greater variety of ways exists in which these forces can be made to act on a migration layer either uniformly or imagewise.

Evidencing the versatility of this invention, modes of imagewise applying an imagewise migration force to migration layer material hereof according to mode (A) above include:

a. applying an imagewise charge to a migration layer which produces an imagewise attraction of the migration layer material to opposite polarity charges induced, by the charges originally applied on the migration layer, on the opposite face of the softenable layer or on the substrate of an imaging member;

b. applying an imagewise external electric field acting on a uniformly charged migration layer;

c. applying a uniform external electric field acting on an imagewise charged migration layer;

d. applying an imagewise magnetic field acting on a uniformly magnetized migration layer.

It will be seen that the strength of an imagewise electrical or electrostatic migration force, the preferred migration force of this invention will depend upon the strength of the electric charge on or in the migration layer and the strength of any external electric field. The generation of the charge on or in the migration layer may be affected by:

i. the distribution of the charge put on or in the structure including on or in the migration layer;

ii. the abillity of the migration layer to hold charge;

iii. the ability of the softenable layer to hold charge;

iv. the magnitude of the electric field through the imaging member.

Modes of applying a migration force to migration layer material hereof in mode (B) where this force is accompanied by imagewise changing the resistance of said softenable material to migration of migration material include:

a. applying a uniform change to a migration layer which produces a uniform attraction of the migration layer material to opposite polarity charges induced, by the uniform charge layer originally applied on the migration layer, on the opposite face of the softenable layer or on the substrate of an imaging member;

i. applying an external field to act on a uniformly electrostatically charged migration layer;

c. applying magnetic fields acting on uniformly magnetized migration layer;

d. applying centrifugal forces on the migration layer;

e. applying gravitational forces on the migration layer.

In mode (B) it will also be seen that imagewise changing the resistance to migration of migration layer material through the softenable layer includes any change of the softenable material or the migration material which directly or indirectly changes the softenable material's viscosity during migration in the region in which the migration material moves or which in any other way changes the viscous drag of migration material in the softenable material.

Figure 1B:
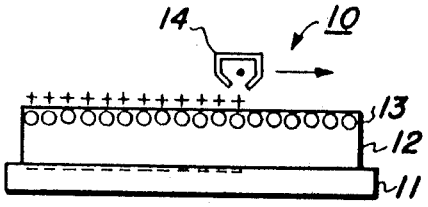
Figure 1C:
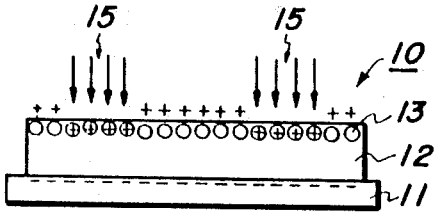

Referring now more specifically to the imaging modes hereof and to FIGS. 1B and 1C, a latent image is formed by the optimum electrical-optical mode hereof, mode A(a), in a member 10 with a layer 13 comprising photosensitive material by the preferred method comprising the steps of uniform corona charging (FIG. 1B) and imagewise exposing (FIG. 1C). In FIG. 1B, the imaging member is uniformly electrostatically charged, illustratively by means of a corona discharge device 14 which is shown to be traversing the member from left to right depositing a uniform, illustratively positive, charge on the surface of layer 13. Substrate 11 if conductive is typically grounded as the device 14 traverses. For example, corona discharge devices of the general description and generally operating as disclosed in Vyverberg U.S. Pat. No. 2,836,725 and Walkup U.S. Pat. No. 2,777,957 have been found to be excellent sources of corona useful in the charging of member 10. Corona charging is preferred because of its ease and because of the consistency and quality of the images produced when corona charging is employed. However, any suitable source of corona may be used including radioactive sources as described in Dessauer, Mott, Bogdonoff Photo Eng. 6, 250 (1955). However, other charging techniques ranging from rubbing the member, to induction charging, for example, as described in Walkup U.S. Pat. No. 2,934,649 are available in the art. The field within layer 12, preferred for imaging, in the optimum mode hereof may run from a few i.e., about 5 volts/micron to as high as 200 volts/micron for both electrically conducting and insulating substrates. However, images of optimum quality result when the field within layer 12 is from about 40 volts/micron to about 100 volts/ micron.

Where substrate 11 is an insulating material, charging of the member, for example may be accomplished by placing the insulating substrate in contact with a conductive member, preferably grounded and charging as illustrated in FIG. 1B. Alternatively, other methods known in the art of xerography for charging xerographic plates having insulating backings may be applied. For example, the member may be charged using double sided corona charging techniques where two oppositely charged corona charging devices one on each side of the member are traversed in register relative to member 10.

Referring now to FIG. 1C, as a second step in the embodiment of the optimum electrical-optical mode of forming the latent image, after charging, member 10 is exposed to an imagewise pattern of activating radiation 15. For purposes of illustration the surface electrical charges are depicted as having moved into particulate layer 13 in the illuminated areas. Although this representation is speculative, it is helpful for an understanding of the present invention to consider the particles of layer 13 in illuminated areas of layer 13 to have a greater capability of accepting charge. The latent image thus formed especially from the exposure levels given below cannot readily be detected by standard electrometric techniques as an electrostatic image for example as found in xerography and as found in the preferred process mode hereof, so that no readily detectable change in the electrostatic or coulombic force is found after exposure although when layer 12 is softened the latent image formed as a result of the charging and exposing steps selectively in image configuration causes the particles to migrate.

Any suitable exposure level may be used. Exposures for optimum quality images will depend on many factors including photosensitive migration layers of composition other than the preferred materials comprising amorphous selenium. Lower exposures such as about ½ f.c.s. may be used for photosensitive migration layers comprising certain phthalocyanines.

Exposures may be from the migration material layer side or through the rear of a member, with a softenable layer and a support (if used) which are at least partially transparent to the activating radiation.

Uniform exposure or no exposure with uniform softening an uniform migration layer forces can be used with no image pattern present to result in films of desired optical density for desired colors. This provides an advantageous way of producing light filters of special light scattering structures.

Any suitable actinic electromagnetic radiation may be used. Typical types include radiation from ordinary incandescent lamps, X-rays, beams of charged particles, infra red, ultra violet and so forth. The imagewise exposures may be before, during or after charging and before or during developing of the softenable layer, wherein the photosensitivity employed is permanent, persistent or temporary. Also the latent image may result from the heating effects of the incident radiation pattern, either on the softenable layer or the migration layer to produce an imagewise change in conductivity thereby producing an electrical migration force pattern. The above described process embodiment of the electrical-optical imaging mode hereof is preferred because of its simplicity, versatility and because of the high quality images produced.

An alternative imaging member construction which may be used with the above described method steps in the optimum electrical-optical mode hereof is to use a member comprising a photosensitive softenable layer and a migration layer of a material which need not be photosensitive, as more fully described in copending application Ser. No. 553,837, filed May 31, 1966.

A variation of the electrical-optical mode is to imagewise heat radiate in the exposure step a thermoconductive softenable layer and/or migration layer, the electrical conductivity of which changes with temperature. Of course, imagewise heating may also be accomplished by non-exposure techniques such as contacting the structure to a heated member in an image configuration. The particles may become quickly discharged or changed in their ability to hold charge, or the discharge or change may occur subsequently in the layer 12 softening step hereof.

According to a preferred process embodiment of the preferred electrical migration force modes hereof, mode A(a), a latent electrostatic image of a type similar to those found in xerography is placed in or on the imaging members hereof by any suitable means, typically which does not employ direct optical exposure of the imaging member, which does not destroy the functionality of the imaging members hereof including:

i. charging in image configuration through the use of a mask or stencil;

ii. first forming such a charge pattern on a separate photoconductive insulating layer according to conventional xerographic reproduction techniques and then transferring this charge pattern to the members hereof by bringing the two layers into very close proximity and utilizing breakdown techniques as described, for example, in Carlson U.S. Pat. 2,982,647 and Walkup U.S. Pat. No. 2,825,814 and 2,937,943;

iii. charge patterns conforming to selected, shaped, electrodes or combinations of electrodes may be formed by the "TESI" discharge technique as more fully described in Scwertz Patents 3,023,731 and 2,919,967 or by techniques described in Walkup Patents 3,001,848 and 3,001,849;

iv. electron beam recording techniques, for example, as described in Glenn Pat. No. 3,113,179, X-ray beam recording techniques wherein X-rays cause secondary emission of electrons which cause the subsequent deposition of charge on members hereof, for example, as described in Reiss, Image Production With Ionizing Radiation Through Electrostatic Accumulation from Electron Avalanches, Zeit. fur Angew. Phys. 19, 1, pp. 1–4 (1965), and Kaprelian U.S. Pat. No. 3,057,997; and v. using a migration member hereof with a photoconductor layer between the softenable layer 12 and the substrate 11. The latent image is formed by typical frost wrinkling sequences, for example, charge, imagewise expose, and recharge to the original potential such as described in Gunther et al U.S. Pat. No. 3,196,011; and Gundlach and Claus, A Cyclic Xerographic Method Based On Frost Deformation, Photographic Science and Engineering 7, No. 1, 14–19 (Jan.–Feb. 1963).

Typically the latent electrostatic image is placed on the member and then the softenable layer is softened but an imaging member with an already softened softenable layer may have a latent charge image deposited on the member to cause migration as soon as the migration layer receives the charge. Photosensitive migration material may be used, with or without uniform exposure to light, after forming a latent charge image by the above described electrical techniques. In some modes, such uniform exposure has been found to enhance migration by lowering the potential of the latent charge image required for migration.

The magnitude of the electrostatic latent image applied in this particular mode of forming a latent image need be only above the threshold to produce migration with the particular combination of materials used. As a practical matter, it is found generally to be preferred to apply a field within layer 12 of at least about 10 volts/micron to insure optimum quality images while images have been produced with charge images producing a field within layer 12 below the 10 volt/micron figure and even below 4 volts/micron.

According to mode (A) (b) hereof oppositely charged image shaped electrodes may be disposed adjacent opposite sides of a uniformly charged imaging member to create an imagewise electrical migration force. Many specific modes of applying forces according to modes (A) (c) and (A) (d) will occur to those skilled in the art upon a reading of this disclosure.

Proceeding now to the (B) mode hereof, according to mode (B) (a) members hereof may be latent imaged by uniformly charging the member and selectively, in image pattern, physically altering, increasing or decreasing, the permeability of the softenable layer to material of the migration layer before, during or after charging. Any suitable technique of imagewise changing the permeability of the softenable layer may be used including:

i. imagewise hardening the softenable layer before, after or during charging for example by exposing certain softenable materials to an image pattern of ultra violet radiation to cause imagewise hardening, for example, by techniques described in Gundlach U.S. Pat. No. 3,307,941. Staybelite Ester 10, for example, may be hardened in image configuration by exposure to a conventional ultra-violet lamp for several minutes through an image mask or stencil.

ii. imagewise softening the softenable layer preferably after charging for example by exposing it to an infra red image pattern or by contacting it with a heated member in image configuration. It softened sufficiently, the subsequent softening step hereof may be omitted. The migration or softenable layers or the substrate or combinations thereof may absorb the infra red to cause the softenable layer to become heated.

Depending upon specific materials employed in the imaging member and especially the material of layer 12, other forms of actinic radiation may be used (either before or after formation of layer 13) to selectively modify (including hardening and softening layer 12) the permeability of layer 12 to particle migration. Suitable methods include: X-ray treatment, Beta ray treatment, Gamma ray treatment and high energy electron bombardment.

iii. imagewise contamination of the softenable layer to effect its viscosity preferably before or after charging for example by condensing volatile components from an adjacent sheet bearing an ink image.

Layer 13 may be formed on layer 12 before or after the permeability changing step.

After the imagewise alteration step, any suitable migration force, typically uniformly distributed over layer 13, may then be applied to layer 13. For example, according to mode (B) (a) layer 13 may be uniformly charged to establish fields in layer 12 similar to those previously discussed above.

According to mode (B) (b) oppositely biased flat shaped electrodes may be disposed adjacent opposite sides of uniformly charged imaging members hereof to create even stronger uniform electrical migration forces across the entire layer 13.

Many specific modes of applying forces according to modes (B) (c), (B) (d) and (B) (e) will occur to those skilled in the art upon reading this disclosure. Illustratively for (B) (d), over relatively long periods for sufficient imagewise softening of layer 12 centrifugal force alone may cause imagewise migration.

The second basic step of this invention is developing i.e., rendering the softenable layer sufficiently permeable to migration of migration material to permit migration or to permit what is often a latent imaged member after the migration force applying step hereof to become visibly (or detectable by other means) imaged. This imaged effect is produced by layer 13 imagewise migrating in depth into the bulk of layer 12, and sometimes all the way to a base of the softenable layer or to the substrate - softenable layer interface if a substrate is used - in the character of a washaway image as described in 460,377 and 483,675. Developing includes both washaway and softening modes. Developing may occur prior, during or following the step of application of the migration force to the migration layer and is the mechanism which permits selected portions of the migration layer to imagewise migrate to locations in depth in the softenable layer, or to the substrate while the remaining migration material may remain substantially unmigrated in or on the softenable layer or migrate a shorter distance in the softenable material or be washed away in the washaway mode of development.

Washaway development is amply described in 460,377 and 483,675.

Softening development herein encompasses any suitable means for rendering the softenable layer more permeable to material from the migration layer including such preferred modes as softening the softenable layer by subjecting it to heat or a vapor of a solvent for the softenable material or combinations thereof, or by relatively short duration exposing of the softenable layer to a solvent therefore, to cause swelling and some softening of the softenable layer. Softening also encompasses the case where layer 12 off the shelf, is sufficiently softened to render unnecessary a separate, distinct softening process step. For example, the migration layer could be deposited on a layer which is softened enough by room temperature so that upon completion of the migration force applying step migration images are formed simultaneously, or soon thereafter.

The selected migration produced by softening development hereof produces an imaged member which may be utilized and viewed in a host of ways.

Although layer 12 and non-migrated areas of layer 13 are not thereby washed away, after completion of the softening development mode of this invention, in contrast to the solvent liquid development, washaway development mode taught in aforementioned 460,377 and 483,675 the image produced may be viewed by its transmitted light, by its reflected light, by its scattered light with or without the unaided eye, and by means of special display techniques, including, for example, focusing light reflected from the member onto a viewing screen. By the above viewing techniques, the image can take the appearance of imagewise changes in the optical path of light passing into and out of the softenable layer while reflecting off of the migrated migration layer.

Images hereof also typically may be viewed by interferometric devices such as interference microscopes and holographic devices. In the latter, the image assumes the character of many close-spaced lines of varying frequency.

Also, the image may be recorded by other imaging methods and the recording viewed or otherwise utilized.

The images hereof are often highly suitable for display by transmitted light especially in the materials embodiment where layers 11 and 12 are at least partially transparent and the material comprising migration layer 13 is substantially opaque. Thus the completely processed member may be used as a projection slide to produce a high resolution display of an image on a viewing screen or the like.

The images may also be displayed by means of a projection system such as shown in FIG. 1F of Gunther et al U.S. Pat. No. 3,196,011 and optical systems employing reflected light such as taught in copending application Ser. No. 619,072, filed Feb. 27, 1967. Readout may also be by means of appropriate sensing means that can detect the selective displacement of particles. For example, magnetic sensing means may be used in conjunction with a migration material having a magnetic component.

The softening development mode hereof and especially the preferred softening techniques of softening the softenable layer by exposure to heat, solvent vapor or combinations thereof will now be described in detail.

Generally in vapor development, an imaging member according to this invention is exposed for a period of time to a solvent vapor, for example, in a chamber, generally in the absence of actinic radiation for the electrical-optical modes hereof. Generally any solvent liquid useful in liquid development, a partial listing of which is included in aforementioned copending application 460,377, is suitable in vapor development according to this invention.

Generally, solvents for vapors used for softening layer 12 herein, should preferably be a solvent for layer 12 but not for layers 11 and 13 and should have high enough electrical resistance, in the electrical-optical and electrical modes hereof, where charges are utilized in the migration force applying step, to prevent the fracturable material of those portions of layer 13 which are to migrate from losing their charge before migrating in depth in the softenable material. Typical solvents for use with the various materials which may comprise layer 12, a partial listing which is found herein, include acetone, trichloroethylene, chloroform, ethyl ether, xylene, dioxane, benzene, toluene, cyclohexane, 1, 1, 1-trichloroethane, pentane, n-heptane, Ordorless Solvent 3440 (Sohio), trichlorotrifluoroethane available under the designation Freon 113 from DuPont, Freon TMC from DuPont, M xylene, carbon tetrachloride, thiophene, diphenyl ether, p-cymene, cis-2, 2-dichloroethylene, nitromethane, n,n-dimethyl formamide, ethanol, ethyl acetate, methyl ethyl ketone, ethylene dichloride, methylene chloride, trans 1,2-dichlorethylene, Super Napholite available from Buffalo Solvents and Chemicals and mixtures thereof.

While vapors of a solvent for the softenable material generally are preferred, some vapors may be used in vapor development which are from liquids which are not solvents or at least not good solvents for the softenable material. For example, the vapors of Freon 113 have been used to cause migration of a material in a custom synthesized 80/20 mole percent copolymer of styrene and hexylmethacrylate softenable material for which Freon 113 is not a ready solvent.

Also, as shown in Example XVI, solvent dip softening may also be accomplished in liquids which are not ready solvents for the softenable layer.

In the imaging modes hereof where charges on the migration layer are not a necessary part of the migration force, of course the electrically insulating nature of the vapor is less of a factor.

Softening times can be shorter for vapor development than for solvent liquid wash away development because no time need be allocated to dissolving off the softenable layer 12. The exposure to the solvent vapor is usually for a short time such as from about ½ second or less up to about 1 minute and generally from about 1 second to about 10 seconds depending inter alia upon the temperature and concentration of the vapor, the strength of the solvent and the softenable layer used. While a practical upper limit of 1 minute may be given for duration of vapor softening, it should be appreciated that, for limited vapor concentrations, for most materials, it is practically impossible to over develop since the migrating particles will reach a point, such as the softenable layer-support surface interface, or where the migrating portions of layer 13 have dissipated their migration force, typically an electrical charge migration force; where migration stops no matter how permeable the softenable layer is. However, for some other materials it is noted that there is some loss of migrated material image definition if vapor development is continued well after complete migration. A limiting factor for vapor development is that for long durations and high vapor concentrations the softenable layer will flow off the substrate and cause the imaging member to lose its form.

In exposing to the solvent vapor, the latent imaged imaging member may simply be held between a pair of tweezers and placed for a few seconds in the vapors contained above a small amount of liquid solvent or developer contained in a bottle. If greater control is desired, a graduated cylinder such as a 2 inch diameteer 1,000 cc. graduate may be used, and partially filled with liquid developer. The member to be developed is then suspended for a few seconds at a predetermined point, such as the 500 cc. mark, while the graduate contains about 200 cc.'s of liquid developer. By using the above technique, images having a consistently high quality can be easily prepared. Of course, any suitable means of controlling vapor intensity may be used and many modes of doing so will occur to those skilled in the art upon reading this disclosure. If desired, the vapor can also be brought to the imaging plate through the use of fans, blowers, or the like, to maintain a constant vapor pressure. While regulation of vapor concentrations and vapor softening times are the primary variables in vapor softening, regulating the temperature of the vapor is another control over development, the warmer vapors generally causing faster softening and migration.

If desired, mixtures of various solvents may also be used. For example, the vapors of a liquid mixture of up to 50% by volume of methylene chloride in Freon 113 provides a satisfactory solvent mixture for vapors.

Referring now to heat softening development, generally, the member is heat softened by exposing the imaging structure, for example, for a few seconds to hot air, infra red exposure, by contacting the substrate to a heated platen, or by dipping the imaging member in a heated non-solvent liquid, such as silicone oil.

The exposure to heat is usually for a short time such as from about 1 second or less up to about 10 seconds or longer depending upon intensity and type of heating used, depending on the particular type of softenable material, its viscosity-temperature relationship and other characteristics. It has been found to be preferred with preferred migration layer materials such as those comprising amorphous selenium, to heat the member from about 50° C. to about 150° C. for about 1 to about 10 seconds to produce optimum quality images.

While, typically, it is difficult to over heat soften, a limiting factor for some materials may be the fusing together of the migrated portions of layer 13 to cause loss of definition of the image of migrated portions of layer 13.

Of course, solvent vapor and heat softening may be used in combination or sequence to soften. For example, see aforementioned copending application Ser. No. 612,122.

The actual structure of the imaged members hereof during processing and after being processed according to the softening, developing mode of this invention, will now be examined in detail.

Figure 2A:
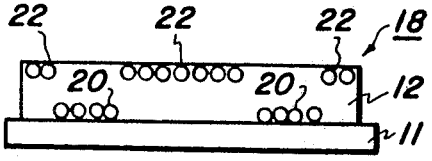
FIG. 2 shows various forms of imaged members according to the invention.

Referring now to FIG. 2A, in some modes of this invention, a migration imaged member 18 results with maximum particle separation in depth. Some particles, illustrated by portions 20, are substantially completely migrated to the base and some particles 22 of migration layer 13 are substantially completely unmigrated. Portions 20 illustratively correspond in image configuration to the pattern of activating electromagnetic radiation 15, described in relation to FIG. 1, portions 22 being a background pattern.

Typically, and as described above with respect to FIG. 2A, the imaging from the process described in relation to FIG. 1 is "positive-to-negative" since optically exposed particles migrate and unexposed particles do not migrate or migrate to a lesser degree. It is also possible to obtain "positive-to-positive" imaging wherein unexposed particles migrate to the substrate or a greater distance than the exposed particles. All of the factors which influence whether a given photosensitive migration layer particle will image in the positive-to-positive to positive-to-negative mode are not fully understood. However, it is known that the imaging mode can be influenced by the choice of (1) sign and magnitude of the applied field or surface charge, (2) choice of softenable material, (3) choice of solvent used in vapor softening; (4) choice of photosensitive particle compositon; as well as other processing variables including temperature. Thus, one should select from the typical photosensitive materials, softening techniques, and softenable materials listed herein, those which will produce images in the desired mode. Techniques for varying the p-p or p-n sense of the resultant images hereof are further described in copending applications Ser. Nos. 642,828 and 658,783, filed June 1, 1967 and Aug. 7, 1967, respectively. This advantageous option of choosing either a p-p (or n-n) or p-n (or n-p) system also applies to washaway development. Thus "an imagewise migration of material" as used in the claims herein is intended to cover both systems.

Figure 2B:
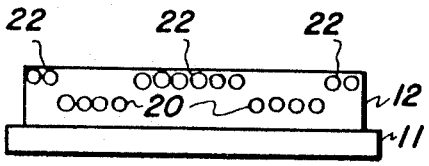

As contrasted to maximum particle migration separation illustrated in FIG. 2A, the imaged member illustrated in FIG. 2B, shows a member imaged hereby where the migrated particles 20 corresponding to particles 20 in FIG. 2A need not and indeed do not migrate all the way to substrate 11, but move or migrate only part way into layer 12, to about the same depth, to yield the image, illustrated in FIG. 2B, which depending on the migrated distance, may appear in reflected light as interference colors associated with a thickness of layer 12 over the partially migrated particles 20. Such part way migration may be due to lower light exposures, lower charge potentials or less intense exposures to softening agents such as solvent vapor, heat and liquid. To produce interference colors the perforated nonfracturable type of migration layer 13 is found to work exceptionally well since migration may be so small as to not fracture the migration layer, thus maintaining its high light reflection which provides for saturated interference colors. Extremely minute changes in the migration distance, as small as less than 0.01 microns, can result in perceptible color changes. FIG. 2E illustrates, in cross section, such a semi-continuous swiss cheese layer of non-fracturable material when imaged as illustrated may be directly viewed as interference colors. Of course, fracturable layers may also be used to produce this interference color image.

Figure 2C:
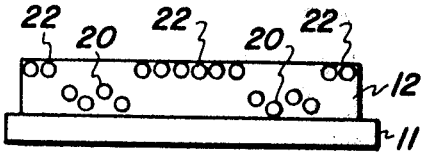

FIG. 2C is representative of a member which has been softened for a relatively short period of time, or in the imaging mode of FIG. 1 wherein the exposure was relatively small, with the migrated particles having not entirely migrated to substrate 11 and not migrated the same distance. Because of scattering and diffraction effects associated with their dispersion or separation in depth, the migrated migration material 20, relative to the unmigrated fracturable material, will transmit more or less light, depending on the practicle size and distribution and the degree of dispersion, and on the color of the light being transmitted, permitting the imaged member to be used as a transparency for imaging members with at least partially transparent substrates and softenable layers.

Thus, because of the dispersion of migrated fracturable material to various depths in the softenable layer, the migration image of FIG. 2C is a visible image in which the migrated areas may appear less opaque or a different color. For example, for members comprising the preferred photosensitive migration layer comprising amorphous selenium, when projected with ordinary white light from an incandescent source the partially migrated areas typically appear blue in transmitted light while the unmigrated areas appear yellow orange to red orange. Generally the partially migrated material will transmit more of the light which selenium strongly absorbs.

Figure 2D:
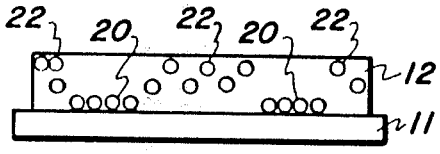
Figure 2E:
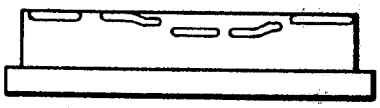

FIG. 2D is representative of an imaged member wherein the migration force is applied as described in relation to FIG. 1 but where the uniform charge prior to exposure is relatively high, which is thought to cause some injection of charge into the fracturable material even in areas of the migration layer which would normally not migrate, so that even these areas have partially migrated to various depths while the areas which would normally migrate have completely migrated to the substrate.

When viewed by transmitted light, using white projector light, the image sense of the imaged member of FIG. 2D is opposite that of FIG. 2C in that typically, dispersed portions 22 of fracturable material in FIG. 2D will transmit more blue light to produce a negative projection transparency from a positive original; for example, if the imagewise illumination 15 of FIG. 1C is the illumination reflected from a positive hard copy original, i.e., relatively darker image areas on a relatively lighter or more light reflective background, such as an ordinary typewritten letter. For the same type of original the imaging member of FIG. 2C would produce a positive projection transparency in that portions 20 of migrated material in FIG. 2C correspond to those portions of the imaging member struck by the imagewise illumination 15 and are the same areas which transmit relatively more blue light while the portions 22 correspond to the dark portions of the original and will transmit relatively less blue light onto a projection image viewing screen. Also as contrasted to FIG. 2C, FIG. 2D when viewed by transmission in white light will appear as a negative image pattern of orangish-red amorphous selenium corresponding to areas 20 in a background pattern of blue associated with fracturable material portions 22 which due to diffraction, light scattering and absorption effects associated with their dispersion to different depths in the softenable material, will appear as blue portions of the imaging member.

The migration images formed by the softening development mode of this invention, some forms of which are illustrated in FIGS. 2A-2E, can have a variety of physical, chemical, electrical, and optical properties based on the imagewise separation of migration material:

a. The migration image has been observed to imagewise selectively discharge by charge transfer upon exposure to light so that it can be charged and uniformly exposed to light to produce a usuable electrostatic image corresponding to the migration image. This charge image, for example, can be rendered visible by conventional xerographic developing techniques.

b. The migration image may be used as a mask to seletively expose the softenable layer to hardening ultra violet radiation. For example, in the FIG. 2C structure, exposure from the top would harden the softenable layer above the migrated migration material portions 20.

c. If the migration image employs migration material which is magnetic, it may then be used as a magnetic image with or without the softenable layer removed.

d. The migration image may be used to produce a different image by selective reaction of the migration material according to its position relative to a reacting substrate or reacting upper surface layer.

e. The migration image, with or without the softenable layer removed, may be used to selectively expose its substrate which may be photosensitive such as a diazo layer, a Kalvar film, a photographic emulsion or a layer of photoresist.

Where a photohardenable (including photosoftenable) photosensitive substrate is used, for example, see Example XXVIII, an etched, relief image may readily be formed from the imagewise photohardened substrate, which relief image, for example may be used as a printing plate. Use of the migration images hereof as an optical mask to form images in or on a photosensitive substrate affords imagewise projection sensitivity (the photohardening radiation typically is a uniform exposure), positive or negative imaging capability and delayed substrate exposure and development. The mask may be removed after the photohardening exposure.

In one embodiment the photosensitive layer may be a photoconductor. When a migration image is formed on the photoconductor and the softenable layer removed, the migration image may be used as an optical mask to produce a xerographic toner image by uniformly electrostatically charging the masked photoconductor, uniformly exposing it to light actinic to the photoconductor to discharge the photoconductor layer in exposed i.e., unmasked areas and then developing the latent charge image with electroscopic marking material. Conventional xerographic steps are used as known to those skilled in the xerographic art and as illustratively disclosed in copending application Ser. No. 709,884, filed Mar. 4, 1968 and references cited therein. The mask may be removed, if desired, after the photoconductor exposure step. If not removed, the toner image typically is formed right over the migration image to give an image of enhanced density or of enhanced or changed color.

The softening development migration image associated with different sensitivity migration materials in the same softenable layer is unique in that it has different materials dispersed differently in depth depending on their sensitivity to the radiation being used. The different migration materials may also require different amounts of charge for migration either because of differences in size or because of differences in charge injection rates. In that case, the fracturable material need not be exposed to radiation to produce the migration image having different materials differently dispersed in depth.

The different fracturable materials may be distributed differently in the softenable layer initially, for example, zinc oxide distributed uniformly through the softenable layer and iron particles distributed as a layer embedded at the upper surface of the softenable layer.

As previously noted, some of the most apparent effects of softening development particle migration are changes in optical transmission, reflection, and light scattering. These effects vary with the wavelength of the light used to view the image. Also as previously noted, part way migration of the migration material 20 may be due to lower light exposure used in forming the latent image.

Thus, a whole range of migration depths and associated dispersions in depth of the migration material may be obtained by changing light exposure only, with other factors such as softening development and potential remaining unchanged. Consequently, the color and optical density of a resultant, developed imaging member changes according to the light exposure. In general, when viewing in transmitted light for which the migration material 20 has a high absorption coefficient; as the amount of light exposure used in forming the latent image is increased, the exposed regions decrease in optical density to some minimum value, and at this point are similar to the migrated areas 20 of the FIG. 2C type image, and then for increasing exposures, other factors remaining constant, the exposed areas increase in optical density to the original film density, and at this point are similar to the migrated areas of the FIG. 2A type image.

Figure 3:
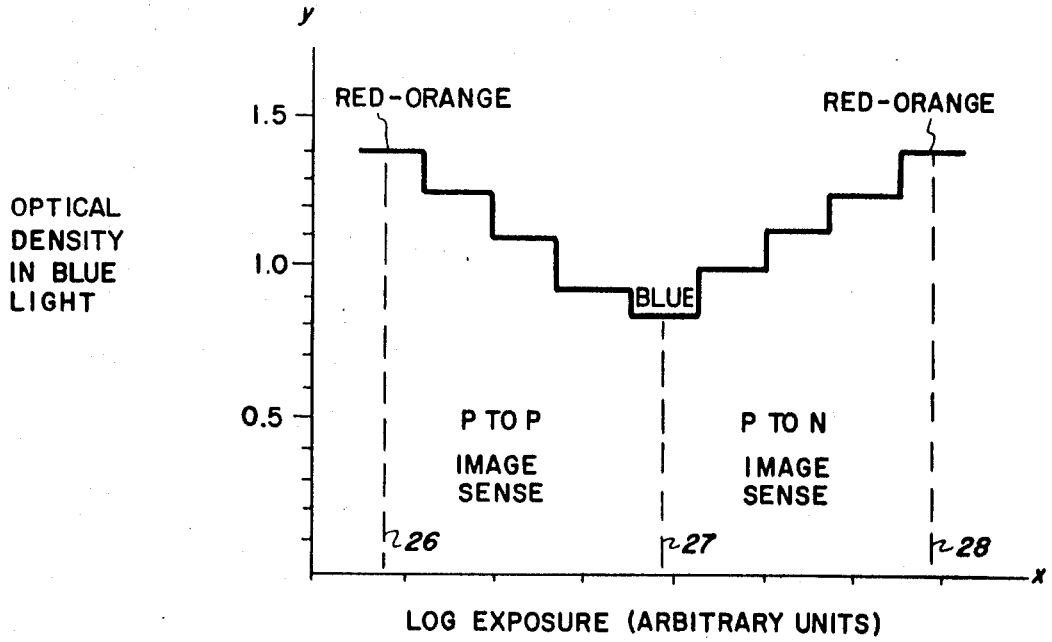
FIG. 3 is a plot of blue light transmission optical density v. log exposure for an imaging member hereof for the preferred migration layer embodiment comprising submicron particles comprising amorphous selenium.

The effect described in the immediately preceding paragraph is illustrated graphically in FIG. 3, in which the blue light optical transmission density and the white projection light transmission color are given for various light exposures of an imaging member having a selenium migration layer. Imagewise exposure to light in the latent imaging steps described in relation to FIG. 1 increases in going from point 26 on the X axis to point 27. The white light transmission color in the exposed areas changes from the original red-orange color of a selenium migration layer to a blue color. The color returns to the original red-orange color as the exposure is increased from point 27 to point 28 on the X axis. The red-orange color corresponds to the negligibly exposed or to the unexposed regions, and to the regions of maximum exposure, while the blue color corresponds to the region of about one tenth maximum exposure.

As can be further seen from FIG. 3, combinations of exposure and viewing light color can produce a positive or negative viewing transparency from a positive original exposure. For example, where the image exposures vary from points 26 to 27, a white light projected transparency produces a positive blue light image i.e., an image of blue areas in a red-orange background where the projection image 15 to produce the latent image was a positive white light image. Where the image exposures vary from points 27 to 28, a white light projected transparency produces a negative blue light image i.e., an image of red-orange areas in a blue background where the projection image 15 to produce the latent image was a positive white light image. Thus, the same imaging member may be used to produce either a positive-to-positive or a positive-to-negative imaging system as desired by the technique of changing the exposure level of the projection image used to produce the latent image.

Migration layers comprising selenium can be made which may or may not substantially change color upon migration imaging. Typically migration layers are used which do change color to obtain migration images that are preferred for use as projection transparencies to produce the original optical exposure image in xerography.

The color change is seen in transmitted light whether viewed by the eye directly or viewed by projection on a screen.

The kind of migration image obtained and colors seen for a given film, potential, and development depends on the exposures present. For example, if only the exposures 26 and 27 are present, then only red-orange and blue areas will be seen. If exposures between 26 and 27 are seen then colors such as red-blue will be seen as well.

In general the blue areas transmit more light which is strongly absorbed by the selenium. Light which is not strongly absorbed by the selenium, such as red light, is more absorbed and scattered by the selenium particles when it is dispersed in the configuration obtained by partial migration, that is in the blue area shown as 27 in FIG. 3.

Each of the imaged members illustrated in FIGS. 2A–2E, and other forms, may be formed by the preferred heat and vapor softening techniques and combinations thereof.

Comparable images are obtainable with heat and with vapor. There are many migration image forms other than those illustrated in FIGS. 2A–2E which are different because the starting structure is different. The starting structure will determine where the relatively unmigrated particles are, how they are distributed and how much more the particles can migrate before reaching the substrate or a surface of the softenable layer.

Since the optical properties of migration imaged members herein (including density, transmissiveness and color) are particle position and particle distribution dependent; experiments were performed to evaluate the use of electron microscopy of ultramicrotomed sections of imaged members, as a tool for measuring particle position as affected by exposure. The experimental procedure was to prepare several migration images processed with softening by vapor or heat, as will be described. The exposures were according to the process of FIG. 1 and were step wedge exposures, including the exposure range for maximum color contrast density change. Ultra-thin cross-sections of the imaged film material for each exposure increment were obtained by mechanical cutting using the ultramicrotome.

The use of this method required that the migration imaged member be embedded in some supporting layers to give it support during the cutting operation. A suitable supporting material was found to be an epoxy system of about 70% Araldite 6020 a liquid aromatic epoxy resin from Ciba Corp. and 30% Lancast A hardener, a polyamine flexibilizer from Lancaster Chemical Corp. This epoxy will cure at room temperature with little exothermal effect and has no apparent chemical effect on the softenable material. A Leitz Ultramicrotome was used to cut sample cross-sections about 500–1000 angstroms thick. The specimens were then placed in a Philips EM200 electron microscope available from Philips Electronic Instruments, Mt. Vernon, New York, for examination.

Figure 4:
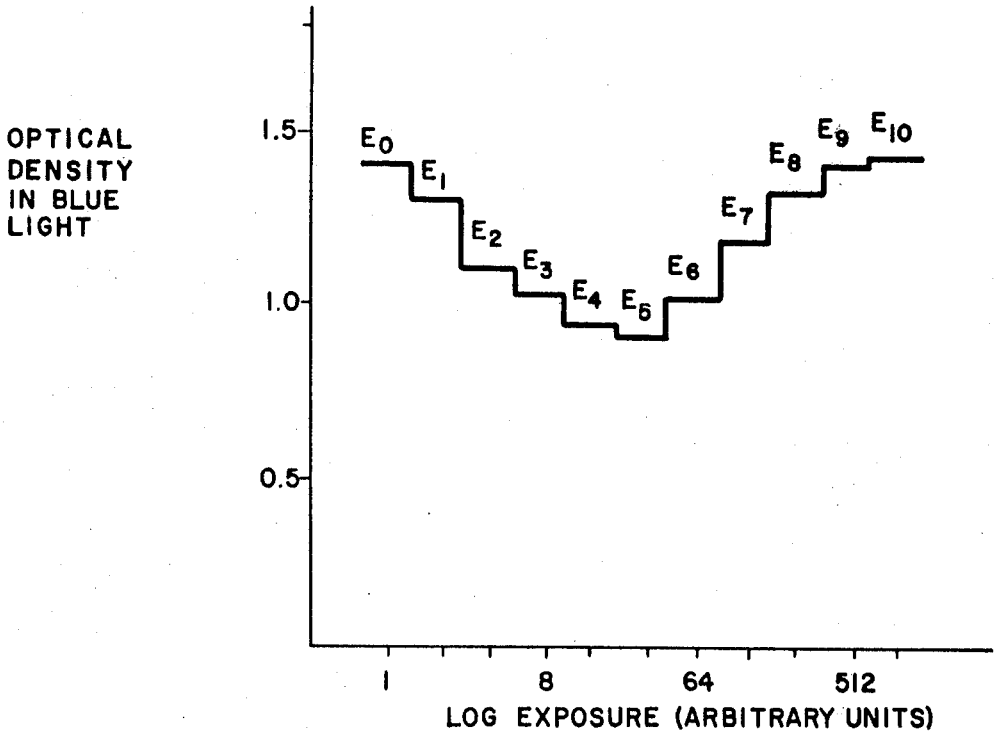
FIG. 4 is another plot of blue light transmission optical density v. log exposure for eleven different exposure levels $E_o - E_{10}$ for a preferred imaging member hereof wherein the migration layer is made up of submicron particles comprising amorphous selenium, and FIG. 5, $E_o - E_{10}$ are eleven drawings of electron micrographs of microtome cross-sections of a member hereof showing various depths of particle migration, the exposure and blue light transmission optical density of each imaged member $E_O$–$E_{10}$ in FIG. 5, shown graphically in FIG. 4 by corresponding portions $E_o - E_{10}$ of the step curve of FIG. 4.
Figure 5:
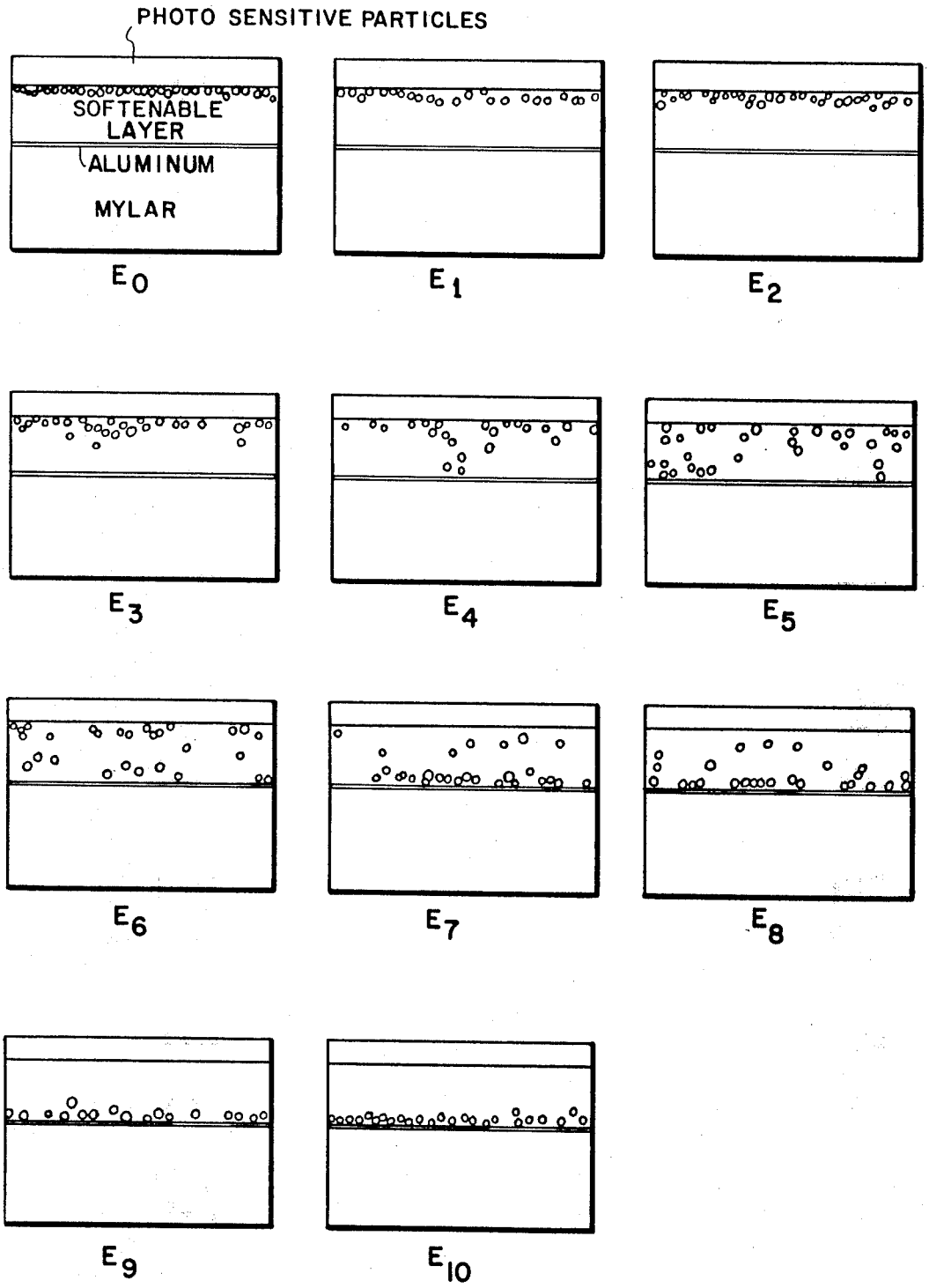

FIG. 5 shows, in micrographs at about 7200X, the particle migration of a uniformly exposed migration imaging member, corresponding to various exposure levels $E_o$–$E_{10}$. FIG. 4 shows blue light transmission optical density v. relative log exposure correlated to the various micrographs $E_o$–$E_{10}$. Each of the micrographs is of the same member subjected to steps of increasingly greater exposures as indicated, each exposure is followed by softening in Freon 113 vapor as described in Example II. The member was initially uniformly charged to a surface potential of about + 140 volts.

It is noted that the exposure, $E_5$ for maximum transmission and for maximum color contrast corresponds to maximum dispersion of the particles in depth. Further, maximum blue light optical density, where transmission is a minimum, is observed for $E_o$ and $E_{10}$ when all the particles lie in a plane, whether the plane is of unmigrated particles positioned near the top surface of layer 12 or completely migrated particles near the substrate.

Above has been described as an invention for providing softening developed migration imaged members of selective, imagewise portions of migration material in depth in a softenable layer. Many uses of such members have also been described. Washawah imaged members have also been described.

It will be understood that the softening developed migration imaged members hereof may be treated or further processed to change their character. For example, a liquid solvent may at any time after softening development be applied to such a migration image to convert it into a solvent wash-away image as taught in 460,377. In this regard, it is further noted that the liquid solvent applied need not be insulating; conductive liquids may be used.

It has also been found that the relatively nonmigrated areas of migration material of a softening developed migration image may be removed by abrasion to yield a more readily visible image, or such areas may be adhesively stripped off or the member split by other techniques to yield complementary positive and negative images. See copending application Ser. No. 784,164 filed Dec. 16, 1968 for further information on removal techniques.

Also the developed resultant image hereof and especially those where vapor softening is employed may be physically transferred from one substrate to another. Alternatively, a thin easily strippable interlayer such as Lexan polycarbonate from G. E. may be used between the softenable layer and the substrate to facilitate stripping, without the need for a sharply acute stripping angle, to be discussed. In one case a Freon 113 vapor softened, resultant imaged member on an aluminized Mylar substrate was placed, migration layer side down, against a sheet of Plestar polycarbonate film from Ansco Div. of General Aniline & Film Corp., and the combination passed through pressure rolls heated to about 100° C. By bending the aluminized Mylar back at a sharp acute angle, to the plane of the top surface of the softenable layer, while stripping, the softenable layer containing unmigrated and migrated migration material in image configuration is transferred intact to the Plestar.

Transmission optical densities herein are measured on a Joyce-Lobel Microdensitometer with illumination by a 3000° K. tungstem lamp, with a S-5 response phototube and 0.1 NA optics. Blue light is produced by filtering through a Corning CS5-56 blue filter and red light is produced by filtering through an Ilford 204 filter with a band pass from 5700 angstroms to beyond 7000 angstroms.

While the migration route traveled by migration material and especially particles has at times been treated herein as being a simple, direct route, electron microscopy has revealed in some imaging embodiments a cellular circulation migration route akin to cellular correction patterns in heat flow.

The following Examples further specifically define the present inventive migration imaging system. The parts and percentages are by weight unless otherwise indicated. All exposures are from a tungsten filament light source, unless otherwise specified. The Examples below are intended to illustrate various preferred embodiments of the migration in depth imaging system of this invention. The Examples are directed primarily to softening development since washaway development is amply described in 460,377 and 483,675.

EXAMPLE I

An imaging member such as that illustrated in FIG. 1 is prepared by first dissolving about 5 parts of Staybelite Ester 10 in about 20 parts cyclohexanone and about 75 parts toluene. Using a gravure roller, the solution is then roll coated onto about a 3 mil Mylar ployester film having a thin semi-transparent aluminum overcoating. The coating is applied so that when air dried for about 2 hours to allow for evaportion of the cyclohexanone and toluene solvent, about a 2 micron layer of Staybelite Ester is formed on the aluminized Mylar. A thin layer of particulate vitreous selenium approximately 0.5 microns in thickness is then deposited onto the Staybelite surface by vacuum deposition utilizing the process set forth in copending patent application Ser. No. 423,167, filed on Jan. 4, 1965.

The member is then migration imaged according to this invention by charging it under dark room conditions to a positive potential of about 100 volts through the use of a corona charging device such as that set forth in Carlson U.S. Pat. No. 2,588,699. The film is then exposed to an optical image, the exposure at about 5 f.c.s. in the illuminated areas. The film is then developed, i.e. softened, while still maintaining dark room conditions, by immersing in vapors of 1,1,1-trichloroethane by holding the film between a pair of tweezers and placing it into a 2 liter bottle containing about 100 c.c.'s of liquid 1,1,1-trichloroethane in the bottom. The film is held above the liquid developer and exposed to the vapors above the liquid for about 3 seconds and then removed from the bottle.

When the film is examined under a microscope, it is found that a migration image has been formed with the image appearing as a partial dispersion of the photoconductive particles in depth in the softenable Staybelite in the areas exposed to light to give a FIG. 2C structure. The image results from the imagewise migration of exposed photoconductive particles to or near the substrate while the photoconductive particles in the unexposed areas remain substantially intact.

When used as a projection transparency, a right reading image of the same image sense as the original optical image, results. For example, when the original image is the focused light reflected from a hard copy original of black or darker image portions on a more light reflective background i.e. an ordinary typewritten paper, the projected imaged member has darker orange image areas appearing in a bluish white background on the projection screen. As the intensity of the projected light is increased, the bluish white background tends to become whiter and the image areas tend to become relatively more orange because more total amount of visible light comes through the background areas.

In green or blue projector light, the projected image appears as a positive of a positive original while in red light, it appears as a negative. Of course, the imaged member hereof can be projected from either side.

EXAMPLE II

A member made according to Example I has a migration force applied and is softened as follows: The member is charged under dark room conditions to a positive potential of about 50 volts by a corona charging device such as that shown in Carlson U.S. Pat. No. 2,588,699. The film is then exposed to an optical image, the exposure at about 10 ergs/cms$^2$ of 4000 angstrom wavelength light in illuminated areas. While still maintaining dark room conditions, the film is vapor softened using the technique in Example I except that the vapors are from the liquid Freon 113 and exposure to the vapors is for a duration of about 2 seconds.

A 2C imaged member results and it is viewed as in Example I.

EXAMPLE III

An imaging member is formed by the method of Example I in which the Staybelite Ester is replaced with a custom synthesized 80/20 mole percent copolymer of styrene and hexylmethacrylate having an intrinsic viscosity of about 0.179 dl/gm (measured in toluene). The resultant member comprises a thin particulate vitreous selenium layer approximately 0.3 microns in thickness deposited in the upper surface of the plastic layer about 2$u$ thick, which is contained on about a 3 mil aluminized Mylar substrate.

The film is charged under dark room conditions to a positive potential of about 200 volts through the use of a corona charging device such as that set forth in Carlson Patent 2,588,699. The film is then exposed to an optical image with an energy in illuminated areas of about 5 f.c.s. A two inch diameter 1000 cc. graduated cylinder is then filled with 200 cc.'s of a 50% mixture of Freon 113 and methylene chloride. While still under dark room conditions the sample film is then suspended for about 4 seconds at the 500 cc. mark of the graduate at about 23° C. When examined under a microscope the film exhibits an image of migrated photoconductor particles, similar to particles 20 in FIG. 2C, formed in the areas struck by the illumination, while the areas which have not been exposed to light retain the photoconductive particles in the upper surface of the plastic, substantially intact. The imaged member is viewed transmissively in white light as a blue image corresponding to the light struck areas, in a red-orange background.

EXAMPLE IV

An imaging plate or film is made according to the method set forth in Example I in which the Staybelite Ester is replaced with Piccopale H-2, with the final plate comprising a thin layer, about 0.5 microns thick, of particulate vitreous selenium contained in the upper surface of about a 2 micron layer of Piccopale H-2 on aluminized Mylar.

The film is charged under dark room conditions to a positive potential of about 200 volts through the use of a corona charging device such as that set forth in U.S. Pat. No. 2,588,699 to Carlson. The film is then exposed to an optical image with energy in the illuminated areas of about 15 f.c.s. Using the graduate of Example III the film is held for 3 seconds at the 500 cc. mark of the graduate above the liquid developer, and then removed from the graduate. The imaged member has a particle migration structure and is viewed similar to the imaged member of Example III.

EXAMPLE V

An imaging member is made by roll coating a sheet of aluminized Mylar with bioloid embedding wax with a melting point of from about 53° C. to 55° C. available from Will Scientific Co. to a finished thickness of about 2 microns. The free surface of the wax layer is then embedded with a mixture of air spun graphite particles, type 200–19 available from the Joseph Dixon Crucible Co. by cascading a mixture of said particles and 50 micron glass beads across the surface of the wax layer to form a layer of graphite about 1 micron in thickness.

An electrostatic image is applied to the plate by means of a corona discharge device and a stencil as more particularly described in copending application 483,675, the image areas being negatively charged to about 200 volts (anywhere from about 100 to 240 volts, being satisfactory however) and the whole structure heated to about 55° C. in an oven at that temperature for about 3 seconds to form a migration image resulting in migration of the charged areas of the graphite layer to the aluminized surface of the polyester film.

A 2A imaged structure results which is not readily seen in transmitted light and is otherwise not readily optically usable. This image may be readily converted into an optically usable image by abrading away or stripping off the free surface of the member thus removing the unmigrated particles 22 in FIG. 2A.

EXAMPLE VI

An imaging member made according to Example III is charged under dark room conditions to a negative potential of about 80 volts.

The film is then exposed in increments between about 0.3 f.c.s. to about 5 f.c.s.

The latent imaged member is softened by blowing hot air at about 130° C. at the member for a duration of about 10 seconds to give an imaged member which appears directly to the eye in transmitted light as ranging from an orange color at the 0.3 to 0.5 f.c.s. region to a light blue color at the 5 f.c.s. region where particles are like particles 20 in FIG. 2C.

The transmission density in blue light at the 5 f.c.s. region is about 0.98 and at the 0.5 f.c.s. and 0.3 f.c.s. exposed regions of the member about 1.66.

The density of the member when viewed transmissively in red light at the 5 f.c.s. region is about 1.2 and the density in the 0.5 f.c.s. and 0.3 f.c.s. regions when viewed in red light is about 0.73.

Transmission densities change monotonicaly between these limits for exposures between these limits.

Thus, it is seen again that the image sense i.e. positive or negative of the imaged member may be changed according to the character, and in this case the color of the projector light used to transmissively view the member.

This change is density depending upon the light used is because of the diffraction, absorption and scattering effects associated with the imagewise particle dispersion in depth, the magnitude of such effects being highly dependent on the wavelength of the viewing light.

EXAMPLE VII

An imaging member similar to the one in Example III is prepared.

The member is uniformly electrostatically charged to a positive potential of about 120 volts.

The member is exposed in increments between about 0.01 f.c.s. and about 2.4 f.c.s.

The latent imaged member is softened by holding the member at the mouth of a small mouth gallon jug having a shallow pool of 1,1,1-trichloroethane liquid at a room temperature of about 75° F. for about 4 seconds.

In the 0.01 and 0.02 f.c.s. exposed areas the member appeared in transmission as orangish-yellow with the imaging member looking similar to the type of that illustrated in FIG. 1A with little or no migration of the photosensitive selenium particles.

In the 0.07 f.c.s. regions of the member, the member appears as orange-red and a cross-section of the member appears similar to portions 22 in FIG. 2D.

In the 0.3 f.c.s. region of the member, it appears blue in transmitted light and a cross section of the member shows a particle dispersion similar to that of particles 20 in FIG. 2C.

In the 1.2 and 2.4 f.c.s. regions of the member, the member appears in transmission as reddish-blue in color and a cross section of the imaged member shows that all or substantially all of the selenium completely migrated to the substrate-softenable layer interface.

Thus, the imaged member gives an image that can be viewed in transmission by the human eye and projected, the image varying from a yellow-orange to an orange-red to a light blue to a reddish-blue image depending upon intensity of the exposure.

When the imaged member is dipped into solvent liquid of 1,1,1-trichloroethane for about 2 seconds, a layer of selenium remained behind on the substrate in the 2.4 and 1.2 f.c.s. areas with some particles remaining behind in the 0.3 f.c.s. areas and no particles being deposited in the 0.07, 0.02 and 0.01 f.c.s. areas to yield a wash-away image, the denser region corresponding to the relatively higher exposed portions of the imaging member with the more transparent regions corresponding to the relatively less exposed areas of the imaging member to produce a positive to negative imaging system.

EXAMPLE VIII

A layered configuration imaging member is made by forming about a 4 micron thick layer of Piccotex 100 on about a 3 mil thick substrate of Mylar film. Over the softenable layer is layered a pigment binder dispersion of X-form metal-free phthalocyanine prepared as described in copending application Ser. No. 505,723, filed Oct. 29, 1965 in Piccotex 100 in a dry weight ratio of pigment to softenable layer of about 1 to 3 and about 10 parts of toluene and about 20 parts of ⅛ inch low carbon steel balls in about a 2 ounce jar and agitated in a Red Devil Quickie Mill for about 30 minutes which forms a dried migration layer of about 2 microns thick.

An imagewise migration force is applied to the member by uniformly electrostatically charging the member to a positive surface potential of about 4,000 volts using single-sided corona charging employing a grounded plate and contact exposing to a positive transparency with the exposure in exposed areas being about 0.10 f.c.s. with substantially no exposure in the unexposed areas.

The latent imaged member is softened by exposing the member to the vapors of toluene for about 5 seconds which produces complete development to cause substantially no migration in exposed areas and substantial migration of particles in unexposed areas to produce a pigment to binder weight ratio at about the substrate-softenable layer interface greater than about 1 pigment to about 1 binder.

The imaged member is then further softened by subjecting it to hot air at about 120° C. for about 5 seconds while contacting a sheet of Mylar and being separated from the Mylar to cause the unmigrated particles to be split off producing a negative image split off and positive image left behind on the original substrate either one of which may be used as a projection transparency or viewed directly by eye in transmitted light.

EXAMPLE IX

A layered configuration imaging member as in Example I is prepared except that the softenable layer is about a 2 micron thick layer of R5061A silicone resin from Dow Corning Corp. The imaging member appears reddish-brown in transmitted light.

The member has an electrical migration force applied to it by uniformly electrostatically charging it to a positive surface potential of about 60 volts and then exposing it in increments between about 0.01 f.c.s. and about 1.2 f.c.s.

The latent imaged member is then vapor soften developed by contacting the member with the vapors from Freon 113 for about 45 seconds to completely develop the member.

In white light the imaged member appears to the unaided eye to be reddish-brown throughout with transmission density decreasing continuously from about 1.4 at the 1.2 f.c.s. and 0.6 exposed areas to about 0.8 at the 0.02 f.c.s. and 0.01 f.c.s. exposed areas to produce a positive to negative imaging system.

EXAMPLE X

An imaging member is prepared by depositing a double layer of softenable material on an aluminized Mylar substrate, the top layer being about a 2 micron layer of Piccopale H-2 containing x-form metal-free phthalocyanine particles of less than about 0.5 microns in average diameter dispersed throughout about the upper half of the layer in a pigment to binder weight ratio of about 1 to 3. The bottom layer is Piccotex 100 about 2 microns thick.

The member is latent imaged by uniformly electrostatically charging it to a positive surface potential of about 200 volts and exposing it to a negative image with exposure in exposed areas being about 0.5 f.c.s.

The latent imaged member is developed by exposing it to the vapors of Freon 113 for about 20 seconds.

An imaged member results wherein the unexposed particles migrate into the Piccotex 100 while exposed particles all remain uniformly dispersed in the HP-100 layer to give an imaged member which appears in transmitted light as a positive.

EXAMPLE XI

An imaging member according to Example I is formed except that the photoconductor layer is a mechanically continuous, perforated, i.e. swiss cheese pattern, film of selenium.

The member is latent imaged by uniformly electrostatically charging it to a positive surface potential of about 200 volts and exposing it to a positive image with exposure in the exposed areas being about 10 f.c.s.

The latent imaged member is developed by exposing it to the vapors of trichloroethylene for about 5 seconds to produce as it appears to the eye, in the unexposed and unmigrated areas a reddish-blue reflected interference color while in the exposed area producing a yellow reflected interference color which appears as a yellow image on a reddish-blue background or in yellow light, as a positive image of a positive original.

EXAMPLE XII

An imaging member is prepared by depositing about a 2 micron layer of Staybelite Ester 10 on an aluminized Mylar substrate. The migration layer is formed by depositing about a 1 micron layer of indigo and Monastral Red B, in intimate mixture in a dry weight ratio of about 1/1 onto the softenable layer.

The member is latent imaged by uniformly electrostatically charging it to a negative surface potential of about 100 volts and then exposing it to alternate strips of red, blue, green and clear transparent filters.

The latent imaged member is developed by exposing it to the vapors of Freon 113 for about 5 seconds.

In the red exposed areas, the indigo predominately migrated to the substrate, in the green exposed areas the Monastral Reb B predominately migrated to the substrate, in the blue areas there was substantially no migration of either type of photosensitive particles and in the white exposed areas the Monastral Red B and the indigo migrated completely to the substrate.

EXAMPLE XIII

An imaging member is prepared by forming on an aluminized Mylar substrate, a softenable layer about 2 microns thick of a Staybelite Ester 10 binder and zinc oxide particles about 0.5 microns in average diameter uniformly dispersed throughout the upper half of the binder in a dry weight ratio of pigment to binder of about 1/1. The migration layer is about a 0.5 micron thick layer of iron powder embedded at the upper surface of the softenable layer.

The member is latent imaged by uniformly electrostatically charging it to a negative surface potential of about 240 volts and exposing it to an image with exposure in exposed areas being about 200 f.c.s.

The latent imaged member is developed by exposing it to the vapors of Freon 113 for about 10 seconds to migrate the iron particles and zinc oxide particles in only the unexposed areas. The imaged member is more transparent in the non-exposed areas.

EXAMPLE XIV

An imaging member is prepared as described in Example III but the photosensitive layer of selenium is overcoated with about a 0.5 micron layer of photographic gelatin. The gelatin is formed by dip coating a layer of photographic gelatin dissolved in water onto the vacuum evaporated selenium layer.

The member is latent imaged by uniformly electrostatically charging it to a positive surface potential of about 200 volts and exposing it to a positive optical image with exposure in the illuminated areas being about 10 f.c.s.

The latent imaged member is then developed by contacting it with hot air at about 100° C. for about 10 seconds to cause partial migration of the selenium particles in the unexposed areas to produce a negative transmission and reflection viewable image with low background.

It is thought that the image sense of positive to negative is caused by an agglomeration or fusing effect of the partially migrated particles which cause the partially migrated portions of the imaged member to become substantially transparentized leaving the more dense unmigrated, exposed areas.

EXAMPLE XV

An imaging member similar to the one in Example III is prepared.

The member is uniformly electrostatically charged by corona to a positive surface potential of about 37 volts.

The member is exposed in increments between about 2.4 f.c.s. and about 0.3 f.c.s. The latent imaged member is developed by holding the member at the mouth of a small gallon jug having a shallow pool of 1,1,1-trichloroethane liquid at a room temperature of about 75° F. for about 10 seconds. In the 0.03 and 0.07 f.c.s. exposed areas the member appears in transmission as orangish-yellow with the imaging member looking similar to the type as illustrated in FIG. 1A with little or no migration of the photosensitive selenium particles.

In the 0.15 f.c.s. exposed areas the member appears in transmission as orange-red and a cross-section of the member shows migrated particles similar to portions 22 of FIG. 2D.

In the 0.3 f.c.s. exposed regions the member appears in transmission as bluish-red, migrated particles appearing similar to portion 22 of FIG. 2D but with a greater migration in depth than in the 0.15 f.c.s. exposed area.

In the 1.2 f.c.s. and 2.4 f.c.s. exposed areas the imaging member appears as a blue member and a cross-section of the member shows a migrated particle dispersion similar to that of particles 20 in FIG. 2C.

When the member is dipped into solvent liquid 1,1,1-trichlorethane for about 2 seconds, the softenable material and all portions of selenium particles from the migration layer in the 0.3 to 0.03 f.c.s. exposed regions being removed while in the 1.2 and 2.4 f.c.s. exposed regions some of the particles are removed and some are desposited on the substrate yielding a wash-away image in the dense regions corresponding to the relatively higher exposed portions of the imaging member with the more transparent regions corresponding to the relatively less exposed areas of the imaging member to produce a positive to negative imaging system.

EXAMPLE XVI

An imaging member made according to Example III is charged under dark room conditions to a positive potential of about 100 volts. The film is then exposed in increments between about 3.0 f.c.s. and about 0.007 f.c.s. The latent imaged member is developed by immersing in Freon 113 liquid for about 10 seconds.

In the areas from 3.0 to 1.5 f.c.s., the film is its original orange color as seen in transmission using white light. Below this exposure, the film's color changes to reddish-orange, to red at 0.07 f.c.s., to reddish-purple at 0.015 f.c.s. and to blue at exposures below about 0.015 f.c.s.

The orange colored areas have particles positioned like particles 22 of FIG. 2C. The blue areas have particles positioned like particles 20 of FIG. 2C.

The resulting image is a migration image in which the plastic layer 12 is still present because the effect of the immersion in the Freon 113 was not to dissolve away but to swell and otherwise render layer 12 of this Example more permeable to migrating selenium particles.

EXAMPLE XVII

An imaging member is prepared by depositing about a 2 micron layer of Staybelite Ester 10 on an aluminized 3 mil Mylar substrate. The migration layer is formed by depositing about 0.5 micron layer of iron particles carried by cascading about 50 micron steel beads carrying the particles over the Staybelite layer and subsequently heat-softening the Staybelite layer to seat the particles in the Staybelite.

The member is latent imaged and developed simultaneously by placing it in the vapors of 1,1,1-trichloroethane for about 10 seconds while bringing a shaped magnet against the back of the film.

As a result, the iron particles migrate in depth and cluster at the edges of the magnet forming an outline of the magnet in which the outline appears more dense. Also the image can be made more visible by splitting off the unmigrated particles leaving only the migrated particles which appear as an outline of the magnet.

EXAMPLES XVIII – XX

Example V is followed except that iron oxide, garnet, and iron particles respectively are used in place of the graphite.

EXAMPLE XXI

An imaging member is prepared as in Example XVII. The member is corotron charged imagewise to about -100 volts through a grounded metal mask or stencil. The latent imaged member is then developed by exposing to Freon 113 vapor for about 5 seconds to form a migration image in which the particles have fully migrated in the areas which received charge.

EXAMPLE XXII

An imaging member is prepared as in Example XVII but where garnet particles are used in place of the iron and glass beads in place of the steel beads.

The member is corotron charged imagewise through a grounded metal mask to a potential in imagewise charged areas of about +95 volts. The latent image is developed by exposure to cyclohexane vapors for about 2 seconds to form a migration image like that of Example XXI.

EXAMPLE XXIII

An imaging member is prepared as in Example XXII except iron oxide particles are used in place of the garnet particles.

The member is charged and developed as in Example XXII to produce a migration image like that of Example XXII.

EXAMPLE XXIV

An imaging member is prepared as in Example XXII except air spun graphite particles (Type 200–19 available from Joseph Dixon Crucible CO., Jersey City, New Jersey) are used in place of the garnet particles and Piccotex 100 in place of the Staybelite 10.

The member is corotron charged imagewise through a grounded metal mask to a potential of about +20 volts. The latent image is developed as in Example XXII to produce a migration image similar to that of Example XXII.

EXAMPLE XXV

Example XXIV is followed except that a charge image of about +60 (voltages anywhere from 2 to 200 volts being satisfactory however) volts is used and after vapor softening the imaged member is immersed in liquid cyclohexane for about 10 seconds to remove the Piccotex 100 and the unmigrated particles to produce a faithful, clearly visible replica of the resultant image in the form of graphite on the substrate.

EXAMPLE XXVI

The imaging member of Example III wherein the aluminum layer is of a thickness to be about 50% white light transmissive, is uniformly charged in darkness to a negative surface potential of about 80 volts. The member is uniformly exposed at about 10 f.c.s. The member is then exposed to an infra red radiation image (from either the migration layer or substrate side) to heat the softenable layer to about 110° C. for about 3 seconds to cause migration of selenium in the infra red exposed areas.

EXAMPLE XXVII

The imaging member of Example V is uniformly charged to a negative surface potential of about 200 volts. The member is then exposed to a radiation image rich in infra red to heat the softenable layer to about 55° C. for about 3 seconds to cause migration of selenium in the imagewise exposed areas.

EXAMPLE XXVIII

An imaging member is made up of a migration layer according to Example VIII overlying about a 4 micron layer of Piccotex 100 overlying about a 0.5 micron layer of Kodak Photoresist (KPR) overlying an aluminized Mylar substrate.

The member is unformly charged, exposed to an imagewise pattern of visible light of about 3 f.c.s. in exposed areas.

The softenable layer is softened in Freon 113 vapor to cause imagewise migration and then dipped in Freon 113 liquid to form an imagewise optical mask of phthalocyanine particles on the KPR.

The masked member is then uniformly exposed for about one minute to ultra violet radiation from two Sylvania F4T5/BLB bulbs held about 1 inch away. The member is then dipped in trichlorethylene for about 30 seconds to dissolve away the KPR primarily in the masked areas to form a raised image pattern corresponding to the unmasked areas.

Although specific components and proportions have been stated in the above description of preferred embodiments of the migration imaging system hereof, other suitable materials as listed herein may be used with similar results. In addition, othere materials and other configurations of the imaging member may be provided and variations may be made in the various processing steps to synergize, enhance and otherwise modify the system. For example, various plasticizers, additives, moisture and other "proofing" agents may be added to the softenable materials as desired. Dyes and coloring agents may also be added.

"Contiguous", for the purpose of this invention, is defined as in Webster's New Collegiate Dictionary, Second Edition, 1960; in actual contact; touching; also, near, though not in contact; adjoining.

It will be understood that various other changes in the details, materials, steps and arrangements of the members which have been herein described and illustrated in order to explain the nature of the invention will occur to and may be made by those skilled in the art upon a reading of this disclosure and such changes are intended to be included within the principle and scope of this invention.

What is claimed is:

1. An imaging method comprising the steps of:

a. providing an imaging member comprising a layer of migration material spaced apart from at least one surface of, but contacting a softenable layer;

b. applying a migration force to said migration layer; and c. imagewise developing the softenable layer to change its resistance, in image configuration, to migration of material from the migration layer to cause an imagewise migration of migration material at least in depth in said softenable layer.

2. An imaging method according to claim 1 wherein said softenable layer is on a substrate spaced apart from said migration layer.

3. An imaging method according to claim 2 wherein said substrate is electrically conductive.

4. An imaging method according to claim 2 wherein said migration layer is fracturable and from about 0.01 to about 2.0 microns thick.

5. An imaging method according to claim 4 wherein said fracturable migration layer comprises particles with an average particle size between about 0.01 and about 2.0 microns.

6. An imaging method according to claim 5 wherein the average particle size is between about 0.01 and about 0.7 microns.

7. An imaging method according to claim 4 wherein said softenable layer is from about ½ to about 16 microns thick.

8. An imaging method according to claim 7 wherein said migration layer is photosensitive.

9. An imaging method according to claim 8 wherein said migration layer is photoconductive.

10. An imaging method according to claim 2 wherein said migration layer is thermoconductive.

11. An imaging method according to claim 1 wherein said migration layer is substantially photosensitively including photoconductively inert.

12. An imaging method according to claim 1 wherein said migration layer is magnetizable.

13. An imaging method according to claim 2 wherein said migration layer is fracturable and is contiguous that surface of said softenable layer opposed to the softenable layer surface-substrate interface.

14. An imaging method according to claim 13 wherein said fracturable migration layer is between about 0.01 to about 2.0 microns thick and is photosensitive.

15. An imaging method according to claim 14 wherein said photosensitive fracturable layer comprises selenium.

16. An imaging method according to claim 15 wherein said photosensitive fracturable layer comprises amorphous selenium.

17. An imaging method according to claim 1 wherein said softenable layer is substantially electrically insulating and said migration force is substantially uniform and is applied to said migration layer by steps comprising uniformly electrostatically charging said member.

18. An imaging method according to claim 17 wherein the electric field within the softenable layer is greater than about 10 volts/micron.

19. An imaging method according to claim 17 wherein said force applying step includes applying an external electric field to said member.

20. An imaging method according to claim 19 wherein the total electric field within the softenable layer resulting from said uniform charging and external electric field applying steps is greater than about 10 volts/micron.

21. An imaging method according to claim 1 wherein said migration force is substantially uniform and is applied to said layer by steps comprising applying a uniform magnetic field to a uniformly migration layer.

22. An imaging method according to claim 1 wherein said migration force is substantially uniform and comprises the earth's gravitational force.

23. An imaging method according to claim 1 wherein said migration force is substantially uniform and comprises centrifugal force.

24. An imaging method according to claim 1 wherein said imagewise developing is by steps comprising exposing a softened softenable layer to an image pattern of hardening radiation.

25. An imaging method according to claim 2 wherein said imagewise developing is by steps comprising exposing a softenable layer to an image pattern of hardening radiation and applying a developing agent to said softenable layer to cause developing in the relatively softer areas.

26. An imaging method according to claim 2 wherein said imagewise developing is by steps comprising exposing the softenable layer to an image pattern of softening radiation.

27. An imaging method comprising the steps of:

a. providing a softenable layer;

b. imagewise developing said layer to change its permeability in image configuration;

layering a migration layer on said imagewise developed softenable layer; and d. applying a migration force to said migration layer.

28. An imaging method according to claim 25 wherein said migration force is substantially uniform.

29. An imaging method according to claim 25 wherein said developing agent comprises heat.

30. An imaging method according to claim 25 wherein said developing agent comprising the vapor of a softening liquid for said material.

31. An imaging method according to claim 25 wherein said developing agent comprises heat and the vapor of a softening liquid for said material.

32. An imaging method according to claim 29 wherein said softenable material is heated to between about 50° C. to about 150° C.

33. An imaging method according to claim 32 wherein said softenable material is maintained in said heated condition for from about 1 to about 10 seconds.

34. An imaging method according to claim 30 wherein said material is exposed to said softening liquid vapor for a period of from about ½ to about 60 seconds.

35. An imaging method according to claim 16 wherein said migration layer is photoconductive and wherein said migration force applying step includes a uniform exposure to activating radiation simultaneous with or after said charging step.

* * * * *